US005323552A

United States Patent [19]

Fritz

[11] Patent Number: 5,323,552

[45] Date of Patent: Jun. 28, 1994

[54] PHOTO DISPLAY METHOD AND APPARATUS

[76] Inventor: Wayne L. Fritz, 11129 Decatur Plaza #522, Omaha, Nebr. 68154

[21] Appl. No.: 891,824

[22] Filed: Jun. 1, 1992

[51] Int. Cl.[5] ..... G09F 7/00

[52] U.S. Cl. ..... 40/159; 40/605

[58] Field of Search ..... 40/159, 152, 642, 605, 40/661; 229/1.5 R, 71, 72; 383/38, 39, 37

[56] References Cited

U.S. PATENT DOCUMENTS

| | | | |
|---|---|---|---|
| D. 322,097 | 12/1991 | Fritz | D20/42 |
| 2,100,298 | 11/1937 | Baxter | 206/38 |
| 2,728,450 | 12/1955 | Haire | 206/459.5 |
| 2,737,742 | 3/1956 | Leigh | 40/605 |
| 2,776,085 | 1/1957 | Furey | 229/69 |
| 2,996,239 | 8/1961 | Lennartz | 229/72 |
| 3,311,145 | 3/1967 | Zalk | 333/9 |
| 3,471,959 | 10/1969 | Seger | 40/605 X |
| 3,642,191 | 2/1972 | Roof | 229/77 |
| 3,750,938 | 8/1973 | Wiseman | 229/77 |
| 4,017,989 | 4/1977 | Murray | 40/605 X |
| 4,234,086 | 11/1980 | Dorton | 206/362 |
| 4,244,762 | 1/1981 | Holson | 40/159 X |
| 4,287,986 | 9/1981 | Beck | 206/45.19 |
| 4,532,727 | 8/1985 | Klose et al. | 40/152 |

FOREIGN PATENT DOCUMENTS

| | | | |
|---|---|---|---|
| 2618325 | 11/1977 | Fed. Rep. of Germany | 40/605 |
| 2196845 | 5/1988 | United Kingdom | 40/152 |

*Primary Examiner*—K. J. Dorner
*Assistant Examiner*—Cassandra Davis
*Attorney, Agent, or Firm*—John A. Beehner

[57] ABSTRACT

A method for displaying and protecting photographic prints includes providing one or more photographic prints and a set of pockets including a back sheet and one or more front sheets, each constructed of a flexible, moisture-resistent material and connected to form a plurality of print-receiving pockets each of sufficient dimension to accept a photographic print. A photographic print is slid into a pocket resulting in the pocket substantially enclosing, displaying, protecting and supporting the print in substantially coplanar relation to prints supported in other pockets. The method also provides a front sheet of a translucent material to allow viewing of prints enclosed therein. Also provided are a plurality of connection devices which will allow two or more sets of pockets to be connected for display purposes. The connection devices provided by the method include a plurality of holes formed adjacent each of the edges of each set of pockets, the holes formed such that upon arranging adjacent edges of two sets of pockets to align the holes on the edges, snap-fit buttons may extend through the holes and secure the sets of pockets to one another. Photographic prints thus may be inserted into the print-receiving pockets and thereby be displayed and protected.

13 Claims, 3 Drawing Sheets

PHOTO DISPLAY METHOD AND APPARATUS

BACKGROUND OF THE INVENTION

1. Technical Field

This invention relates to a photo display method and apparatus and, more particularly, to a method and apparatus for displaying and protecting photographic prints which includes providing a set of pockets into which the photographic prints may be slid, thereby displaying and protecting those prints.

2. Description of the Prior Art

The vast majority of persons who take photographs do so to display them at a later time. Many persons choose to display these photographs in an album or the like. However, some choose to display their photographs on a wall or other such vertical support. Merely placing a photograph on a wall, however, greatly increases the risk of the photograph being damaged or fading with the passage of time. One alternative is to put the photograph to be displayed in a picture frame. These, however, often can be expensive and furthermore can be very difficult to install the photograph in. Also, once a photograph is placed in a frame, it can be difficult to remove the picture from the frame and replace it with another. There is therefore a need for a method and apparatus for displaying and protecting photographic prints combining the ease of merely hanging photographs on a wall with the protective elements found in mounting the photograph in a frame.

Therefore, an object of the present invention is to provide an improved method and apparatus for displaying and protecting photographic prints. Another object of the present invention is to provide a method for displaying and protecting photographic prints which will allows for simple and quick exchange and replacement of photographic prints held therein.

Still another object of the present invention is to provide a method for displaying and protecting photographic prints which will provide protection against physical damage or fading of the prints.

Yet another object of the present invention is to provide a method for displaying and protecting photographic prints which may be easily expanded to provide additional display space for greater numbers of photographic prints.

Finally, an object of the present invention is to provide a method for displaying and protecting photographic prints which is simple and inexpensive to manufacture and safe and durable in use.

SUMMARY OF THE INVENTION

The present invention is directed to a method and apparatus for displaying and protecting photographic prints which includes providing one or more photographic prints and a set of pockets. The set of pockets includes a back sheet and one or more front sheets, the back and front sheets constructed of flexible, moisture-resistant material which are connected to form a plurality of print-receiving pockets. Each print-receiving pocket is of sufficient dimension to accept a photographic print in slip-fit relation and to substantially enclose, display, protect and support the print. Each of the front sheets is furthermore constructed of a translucent material to allow viewing of the enclosed objects.

The method further contemplates providing connecting devices adjacent the edges of each set of pockets which allows connection to an adjacent set of pockets having similar connection devices. Thus two or more sets of pockets may be connected together to increase the number of prints which may be displayed.

Finally, the photographic prints are slid into the pockets thus resulting in the prints being displayed and protected.

The apparatus of the present invention comprises the set of pockets described in the method and further including the front sheets attached to the back sheet along a plurality of vertical and horizontal lines, thus forming a plurality of rectangular subdivisions. Each of the generally rectangular subdivisions has three closed sides and one open side, each forming a print-receiving pocket, thus forming a set of pockets for displaying and protecting photographic prints. As described above in reference to the method, each set of pockets may be connected to another for displaying more prints.

This invention thus provides a great advantage over the prior art, which requires a person desiring to display photographs on a wall to purchase a substantially more expensive frame and to engage in a much lengthier mounting process. The present invention, by contrast, allows a person who wishes to display a photograph to merely slide the photograph into a pocket and hang the set of pockets on a wall, after expending minimal effort and money. Another advantage of the present invention is that a person wishing to replace an old photograph with a new photograph need only slide the old photograph out of its pocket and replace it with the new photograph, a process which cannot be done using a frame. The present invention thus provides greater flexibility of displaying photographs than does the prior art.

DESCRIPTION OF THE PREFERRED EMBODIMENT

The term "photographic print," as used in application, refers specifically to photographic prints formed as an end product of a film developing process, and not to photographs reproduced by any printing process, such as baseball cards.

Figure 1:
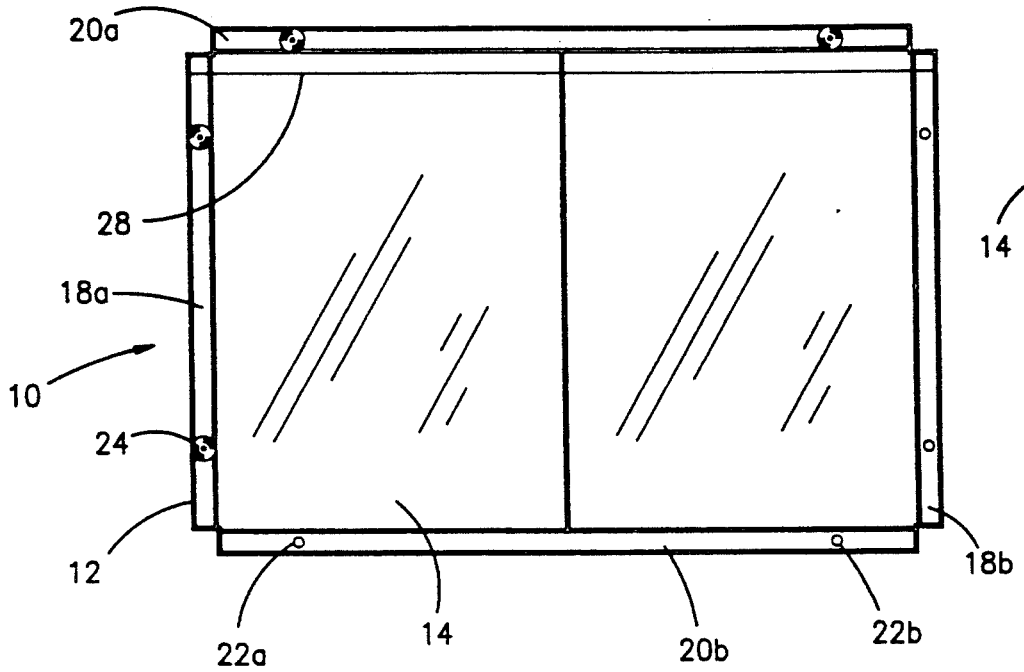
FIG. 1 is a front elevational view of a set of pockets designed to a pair of 8×10 photographs.
Figure 2:
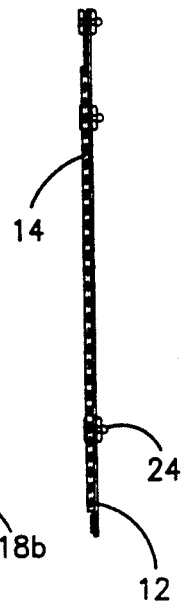
FIG. 2 is a side elevational view of the set of pockets of FIG. 1.
Figure 3:
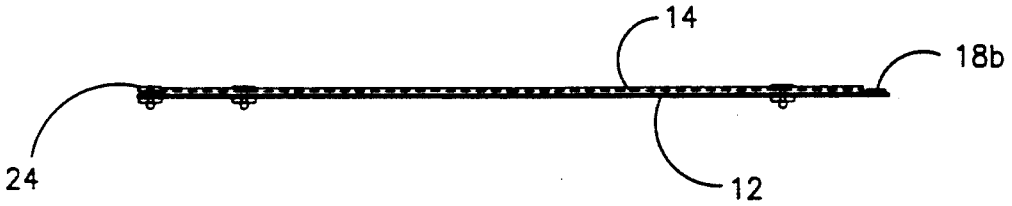
FIG. 3 is a bottom view of the set of pockets of FIG. 1.

A preferred embodiment of the method for displaying and protecting photographic prints of the present invention is shown in FIG. 1 as providing a set of pockets 10 having a back sheet 12 and a front sheet 14. The back sheet 12 is preferably formed of a plastic sheet material, such as POLYPRO, and is preferably opaque. The front sheet 14 is preferably formed of material similar to that used in construction of the back sheet 12, however, this material is preferably translucent, thus allowing photographic prints 16 placed behind the front sheet 14 to be viewed. The back sheet 12 is preferably rectangular and of a width greater than twice the width of the photographic print 16 to be displayed in the set of pockets 10. For example, a set of pockets 10 designed to display and protect two standard five (5") inch by seven (7") inch photographic prints would preferably have a width between eleven (11") inches and fifteen (15") inches, and a height between eight (8") inches and ten (10") inches. As shown in FIG. 1, these dimensions include the four rectangular extensions, one at each side 18*a* and 18*b*, and one at the top 20*a* and one at the bottom 20*b* of the back sheet 12. In the preferred embodiment, a pair of holes 22*a* and 22*b* are formed in each of the rectangular extensions 18*a* and 18*b*, 20*a* and 20*b* to allow connection of one set of pockets to another. The means for connecting a plurality of sets of pockets will be later detailed below.

The front sheet 14 is preferably of the same width as the back sheet 12 but of somewhat smaller height. Referring to the dimensions given in the above example, the front sheet 14 would preferably have a height between seven and one-half (7 ½") inches and nine (9") inches.

Figure 5:
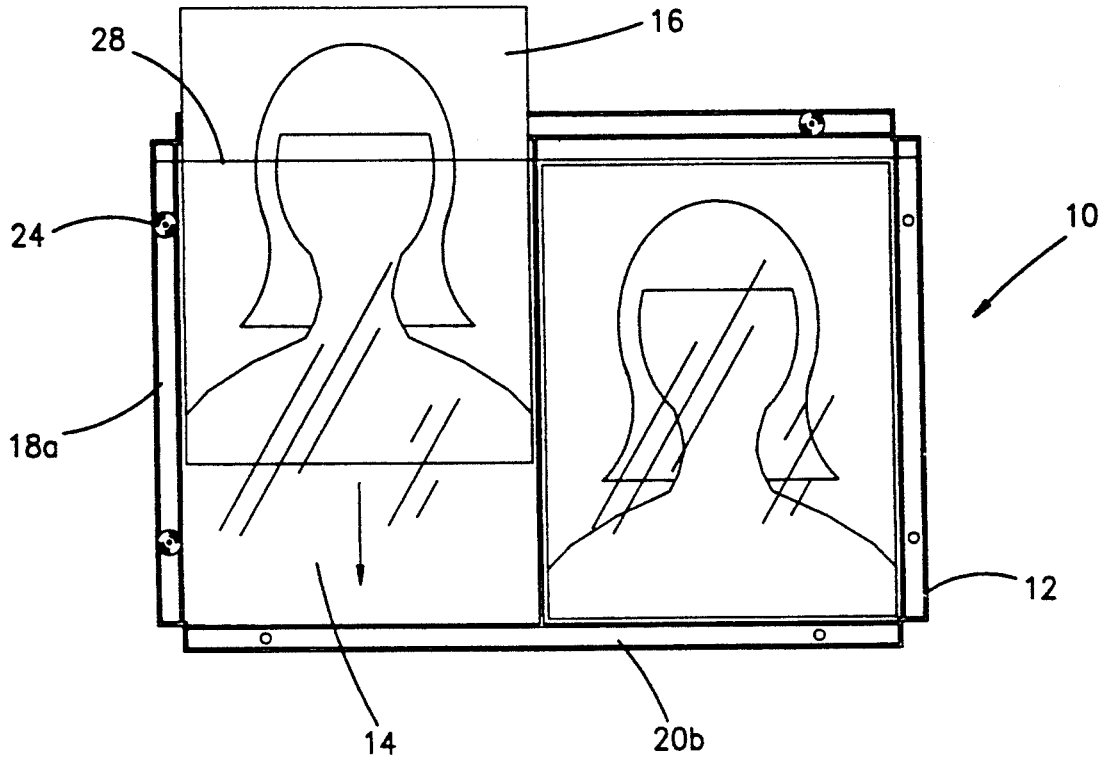
FIG. 5 is a front elevational view showing photographs being inserted into of pockets.

Referring to construction of the apparatus of the present invention, a set of pockets 10 is preferably formed by placing the front sheet 14 on top of the back sheet 12 in face to face relation and aligning the side edges of the front sheet 14 and the back sheet 12, as shown in FIG. 1. The bottom edge of the front sheet 14 is preferably aligned with the top edge of the bottom extension 20*b*, as shown in FIG. 1. A thermal press technique is utilized to attach the front sheet 14 to the back sheet 12. This process consists of a metal die stamp pressing and melting the plastic material of the front sheet 14 and the back sheet 12 along the desired lines of connection. When the front sheet 14 and the back sheet 12 cool the two sheets are connected along those lines, shown on FIG. 1 as close together parallel lines. The top of the front sheet 14 is shown in FIG. 1 as a single straight line 28 running parallel to the top and bottom extensions 20*a* and 20*b*. In this manner two pockets are formed, each closed on three sides and open on one to allow a photographic print 16 to be slid therein, as shown in FIG. 5.

Figure 6:
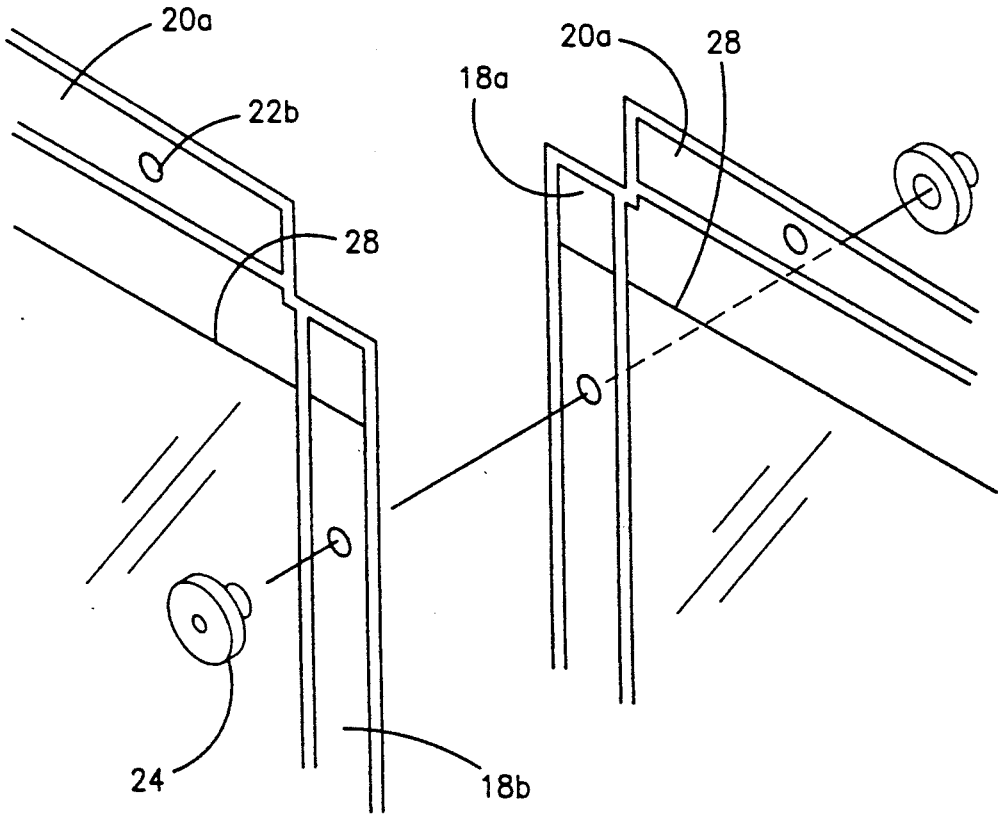
FIG. 6 is a partial enlarged perspective view showing how two sets of may be connected.
Figure 7:
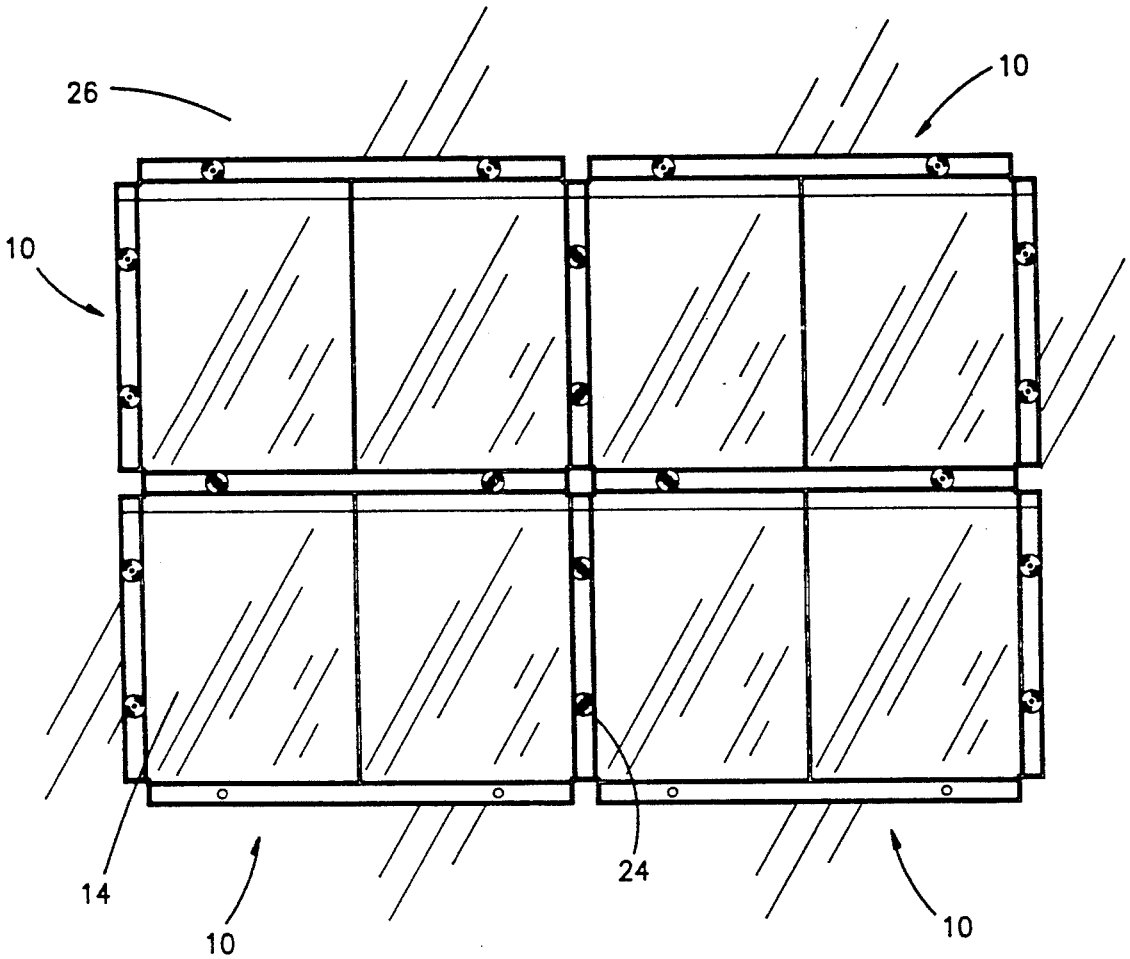
FIG. 7 is a front elevational view of four sets of pockets joined together and supported on a wall surface.

The holes 22*a* and 22*b* on each of the four extensions 18*a* and 18*b*, 20*a* and 20*b* are preferably formed by any conventional plastic punch operation, and in the preferred embodiment have a diameter between one-eighth (⅛") inches and one-quarter (¼") inch. FIG. 6 shows two sets of pockets being connected using the holes and the connection devices 24. It is preferred that the connection devices 24 be conventional snap-fit buttons which extend through and are held by the holes 22*a* and 22*b* and may extend into and be held by another connection device 24. FIG. 7 shows a plurality of sets of pockets 10 connected together by the connection devices 24 and supported on a wall surface 26. A set of pockets 10 may be supported on a wall surface 26 by any conventional hanging means, such as nails or hooks.

Figure 4:
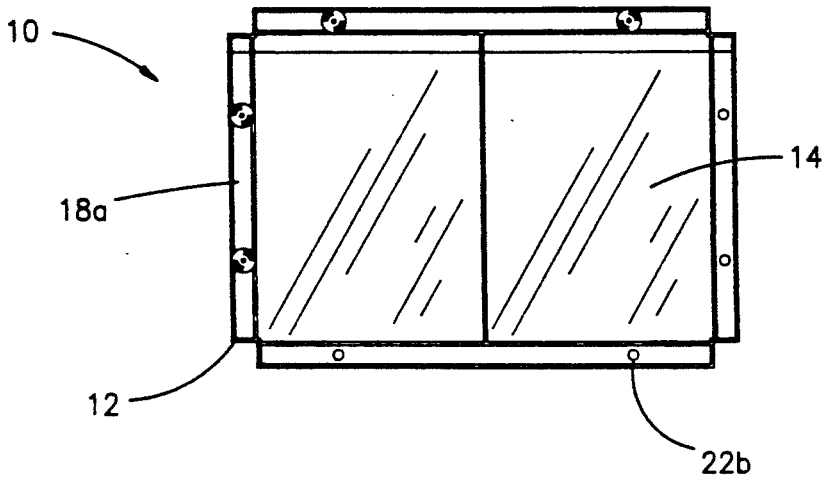
FIG. 4 is a front elevational view of a set of pockets designed to receive a pair a pair of 5×7 photographs.

Shown in FIG. 4 is an alternative embodiment of the present invention designed to accommodate smaller photographic prints.

The present invention thus provides a superior method for displaying and protecting photographic prints. As the present invention is simple to manufacture and is constructed of relatively inexpensive materials, consumer costs can be kept much lower than other display devices, such as frames. Furthermore, photographic prints may be easily slid into or removed from the pockets of the present invention, thus greatly simplifying problems encountered by many using frames. Also, as the entire photographic print is protected by the surrounding plastic, the average life of a photographic print displayed in the present invention will be greatly increased as compared to a photographic print displayed without protection. Finally, a plurality of sets of pockets may be supported by one set of wall hanging devices, such as nails or hooks, as a plurality of pockets may be attached to the first supported set of pockets. This can greatly reduce the substantial defacing of a wall surface often encountered in hanging many frames containing photographic prints thereon.

It is obvious that numerous other modifications and variations of the present invention are possible in view of the above teachings. For example, a set of pockets may be constructed to accommodate any size of photographic print such as eight (8") inch by ten (10") inch or wallet size.

Therefore it is to be understood that the above description is intended in no way to limit the scope of protection of the claims and is representative only of the several possible embodiments of the present invention.

There has thus been shown and described an invention which accomplishes at least all of the stated objects.

I claim:

1. A method for displaying and protecting photographic prints, said method comprising:

providing at least one photographic print;

providing a at least one set of pockets comprising a back sheet and at least one front sheets, said back and front sheets constructed of flexible, moisture-resistant material and connected to form a plurality of print-receiving pockets each of sufficient dimension to accept a photographic print in slip-fit relation and substantially enclose, display, protect and support said print in substantially coplanar relation with prints supported in other pockets, said front sheets comprising translucent material, said set of pockets further including top, bottom and side edges;

providing connection means adjacent said top, bottom and side edges of said set of pockets for connection to an adjacent set of pockets having similar connection means whereby adjacent sets of pockets may be connected together, said connection means including a plurality of holes formed adjacent each of the edges of said set of pockets, said holes formed such that upon arranging adjacent edges of adjacent sets of pockets in overlapping relation, said holes in one set of pockets are aligned with holes in an adjacent set of pockets, said connection means further including at least one connection device for extending through pairs of aligned holes for connection of one set of pockets to another;

inserting said photographic prints into said print-receiving pockets whereby said prints may be displayed and protected; and displaying the protected and supported photographic prints.

2. The method of claim 1 wherein the step of providing a set of pockets comprises providing said back and front sheets made of plastic sheeting.

3. The method of claim 2 wherein the step of providing a set of pockets further comprises providing said back sheet made of opaque plastic sheet material.

4. The method of claim 2 wherein the step of providing a set of pockets further comprises providing substantially rectangular plastic pockets sealed on substantially all of three sides and having widths slightly greater than the width of said print and height slightly greater than the height of said print whereby said print may be protected and secured within said pocket.

5. The method of claim 1 wherein the step of providing connection means which include said connection devices further comprises providing a plurality of having a first and second snap-fit connector member, each of said said first member operative to extend through a pair of aligned holes and to snap-fit connect to said second snap-fit connector member positioned behind another set of pockets, whereby two sets of pockets may be connected together to display a greater number of said photographic prints.

6. The method of claim 1 wherein the step of displaying the protected and supported photographic prints further comprises mounting said set of pockets containing prints on a vertical surface whereby said prints may be prominently displayed.

7. An apparatus for displaying and protecting photographic prints, said apparatus comprising:

a back sheet of flexible, moisture-resistant, opaque material;

at least one front sheet of flexible, moisture resistant translucent material;

said front sheet being attached to said back sheet in face-to-face relation along a plurality of substantially vertical and substantially horizontal lines such that a plurality of generally rectangular subdivisions are formed in said front sheet and said back sheets;

said generally rectangular subdivisions having three substantially closed sides and one open side such that each subdivision formes a print-receiving pocket, thus forming a set of pockets which may accept photographic prints without bending or folding whereby prints may be displayed and protected;

said set of pockets comprising top, bottom and side edges;

a plurality of connection means attached adjacent each of said edges of said set of pockets such that said set of pockets may be connected to adjacent said set of pockets whereby greater numbers of photographic prints may be displayed;

said connection means comprising a plurality of holes formed adjacent each of said edges of said set of pockets, said holes formed such that when adjacent edges of adjacent sets of pockets are in overlapping relation, said holes in one of said set of pockets are aligned with holes in an adjacent said set of pockets; and said connection means further comprising a plurality of connection devices for extending through pairs of aligned holes for connection of one set of pockets to another.

8. The apparatus of claim 7 wherein said front and back sheets comprise plastic sheeting.

9. The apparatus of claim 7 wherein said back sheet further comprises four substantially rectangular notches formed in each corner of said rear plastic sheet.

10. The apparatus of claim 7 wherein said pockets are of sufficient size to accept a standard 5"×7" photographic print.

11. The apparatus of claim 7 wherein said pockets are of sufficient size to accept a standard 8"×10" photographic print.

12. The apparatus of claim 7 wherein said connection means are alternately adapted for mounting said set of pockets on a vertical wall surface for display.

13. The apparatus of claim 7 wherein each of said connection devices comprises a snap-fit connector, said snap-fit connector operative to extend through a pair of aligned holes and to snap-fit connect to another snap-fit connector positioned behind another set of pockets, whereby at least two sets of pockets may be connected together to display a greater number of photographic prints.

* * * * *